US008256151B2

(12) United States Patent
Stafford et al.

(10) Patent No.: US 8,256,151 B2
(45) Date of Patent: Sep. 4, 2012

(54) LIGHTED SIGNAGE STRUCTURE

(75) Inventors: William Y. Stafford, Minnetrista, MN (US); Cheryl J. Penkivech, Apple Valley, MN (US); John P. Farinola, Monroe Township, NJ (US); Charles J. Babboni, Roseland, NJ (US); Krzysztof Sosniak, Wallington, NJ (US)

(73) Assignee: Target Brands, Inc., Minneapolis, MN (US)

( * ) Notice: Subject to any disclaimer, the term of this patent is extended or adjusted under 35 U.S.C. 154(b) by 157 days.

(21) Appl. No.: 12/959,928

(22) Filed: Dec. 3, 2010

(65) Prior Publication Data

US 2012/0137550 A1 Jun. 7, 2012

(51) Int. Cl.
*G09F 7/22* (2006.01)

(52) U.S. Cl. ..... 40/617; 40/606.12

(58) Field of Classification Search ..... 40/617, 40/606.12, 502, 430, 431, 554; 362/405, 362/406, 407; 248/344
See application file for complete search history.

(56) References Cited

U.S. PATENT DOCUMENTS

| | | | | |
|---|---|---|---|---|
| 1,354,262 | A | 9/1920 | Mathieu | |
| D71,038 | S | 5/1926 | Underwood | |
| D89,036 | S | 8/1932 | Chapman | |
| D114,456 | S | 4/1939 | McCabe et al. | |
| 2,195,154 | A | 3/1940 | Scott | |
| D129,362 | S | 9/1941 | Pieper | |
| 2,517,963 | A | 8/1950 | Bausch | |
| 2,608,777 | A | 9/1952 | Schuler | |
| 2,830,395 | A * | 4/1958 | Hutchens | 40/502 |
| D199,834 | S | 12/1964 | Smith | |
| 3,201,881 | A | 8/1965 | Dechar | |
| 3,340,633 | A * | 9/1967 | Silberman | 40/473 |
| 3,759,398 | A | 9/1973 | Romney | |
| 3,854,591 | A | 12/1974 | Schuessler | |

(Continued)

FOREIGN PATENT DOCUMENTS

WO WO 9119934 A1 * 12/1991

(Continued)

OTHER PUBLICATIONS

Moss Inc, "Retail Catalog," pp. 1-24, http://www.mossinc.com/downloads/Retail%20Catalog.pdf (last visited Oct. 7, 2010).

*Primary Examiner* — Joanne Silbermann
*Assistant Examiner* — Kristina Junge
(74) *Attorney, Agent, or Firm* — Leanne Taveggia Farrell; Westman, Champlin & Kelly, P.A.

(57) ABSTRACT

A signage structure includes a first drum, a valance and a plurality of bracket assemblies. The first drum is suspended from a ceiling and includes a first frame supporting a first material having an outer circumferential surface for displaying indicia. The first frame has an upper frame ring and a lower frame ring. The valance is located outwardly from the outer circumferential surface of the first drum and includes at least one curved section having a plurality of spaced apart lights positioned along the interior side of the valance. The plurality of bracket assemblies include arms that couple the upper frame ring of the first drum to the valance. A first end of each arm is configured to attach to the upper frame ring of the first drum and a second end of each arm is configured to attach to the valance.

20 Claims, 12 Drawing Sheets

U.S. PATENT DOCUMENTS

| | | | | |
|---|---|---|---|---|
| 3,984,931 | A | | 10/1976 | Belokin, Jr. |
| 4,001,959 | A | | 1/1977 | Grendahl |
| 4,064,427 | A | * | 12/1977 | Hansen et al. ..... 362/96 |
| 4,091,706 | A | | 5/1978 | Ludwig |
| 4,441,282 | A | | 4/1984 | Thual |
| 4,446,973 | A | | 5/1984 | Fuller et al. |
| 4,454,671 | A | | 6/1984 | Morgenstern |
| D281,790 | S | | 12/1985 | Cobbe |
| 4,747,025 | A | | 5/1988 | Barton |
| 4,776,121 | A | | 10/1988 | Vicino |
| 4,849,864 | A | | 7/1989 | Forrest |
| 4,856,216 | A | | 8/1989 | Gross |
| 4,896,779 | A | | 1/1990 | Jureckson |
| D306,352 | S | | 2/1990 | Glassman |
| 4,994,943 | A | | 2/1991 | Aspenwall |
| 5,057,981 | A | | 10/1991 | Bowen et al. |
| 5,062,534 | A | | 11/1991 | Neustat et al. |
| 5,282,331 | A | | 2/1994 | Fell |
| D350,568 | S | | 9/1994 | Lucarelli |
| 5,528,469 | A | | 6/1996 | Todd, Jr. |
| 5,575,098 | A | | 11/1996 | Goettel-Schwartz |
| 5,617,661 | A | | 4/1997 | Mason |
| 5,647,485 | A | | 7/1997 | Verrangia |
| 5,649,379 | A | * | 7/1997 | Hoffman et al. ..... 40/617 |
| 5,703,564 | A | * | 12/1997 | Begum et al. ..... 340/815.4 |
| 5,832,644 | A | | 11/1998 | Mason |
| 5,924,367 | A | | 7/1999 | Henke et al. |
| 5,992,072 | A | | 11/1999 | Garfinkle |
| 6,082,687 | A | | 7/2000 | Kump et al. |
| 6,193,384 | B1 | | 2/2001 | Stein |
| 6,233,102 | B1 | | 5/2001 | Hogan, Jr. |
| 6,269,570 | B1 | | 8/2001 | Miles |
| 6,321,475 | B1 | | 11/2001 | Glanz |
| 6,341,441 | B1 | | 1/2002 | Morales |
| 6,341,755 | B1 | | 1/2002 | Kump |
| 6,349,863 | B1 | | 2/2002 | Frye |
| D456,550 | S | | 4/2002 | Clodagh |
| D457,364 | S | | 5/2002 | Shea |
| 6,467,209 | B1 | | 10/2002 | Vickers |
| 6,634,125 | B2 | | 10/2003 | Abramson et al. |
| 6,644,606 | B1 | | 11/2003 | Seidel |
| D488,837 | S | | 4/2004 | Dion |
| D489,472 | S | | 5/2004 | Newhouse et al. |
| 6,786,621 | B2 | | 9/2004 | Sviland |
| 6,827,465 | B2 | | 12/2004 | Shemitz et al. |
| 7,293,895 | B2 | | 11/2007 | Grossman et al. |
| D561,928 | S | | 2/2008 | Silver |
| 7,377,061 | B2 | | 5/2008 | Whittier et al. |
| D571,948 | S | | 6/2008 | Chen |
| D580,585 | S | | 11/2008 | Otero |
| D585,584 | S | | 1/2009 | Sabernig |
| D595,891 | S | | 7/2009 | Sabernig |
| D596,337 | S | | 7/2009 | Sabernig |
| 7,610,704 | B1 | * | 11/2009 | Nowicki ..... 40/435 |
| 7,631,982 | B1 | | 12/2009 | D'Onofrio |
| D614,704 | S | | 4/2010 | Ulrich et al. |
| D622,436 | S | | 8/2010 | Whittier et al. |
| 2006/0165529 | A1 | | 7/2006 | Sobel |
| 2008/0093317 | A1 | | 4/2008 | Alves et al. |
| 2008/0130297 | A1 | | 6/2008 | Hui |
| 2008/0282592 | A1 | | 11/2008 | Brinkman et al. |

FOREIGN PATENT DOCUMENTS

| | | | |
|---|---|---|---|
| WO | 200718962 | A2 | 12/2007 |

* cited by examiner

LIGHTED SIGNAGE STRUCTURE

BACKGROUND

Signage displays information to an audience in the form of visual graphics and text. For example, retail stores use signage to convey information to guests, such as to orient guests in physical space and/or to aid the guests in navigation.

In some instances, lighting is used to enhance the visibility of signage. In one example, lighting illuminates all or a portion of the signage, such as the visual graphics or text displayed on the signage.

The discussion above is merely provided for general background information and is not intended to be used as an aid in determining the scope of the claimed subject matter.

SUMMARY

A signage structure includes a first drum suspended from a ceiling. The first drum includes a first frame supporting a first material having an outer circumferential surface for displaying indicia. The first frame has an upper frame ring and a lower frame ring. First ends of a plurality of bracket assemblies that include arms are attached to the upper frame ring of the first drum. A valance is attached to second ends of the plurality of bracket assemblies to locate the valance outwardly from the outer circumferential surface of the first drum. The valance includes at least one curved section having a plurality of spaced apart lights positioned along the interior side of the valance. The plurality of spaced apart lights direct light onto the outer circumferential surface of the first drum.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

Figure 1:
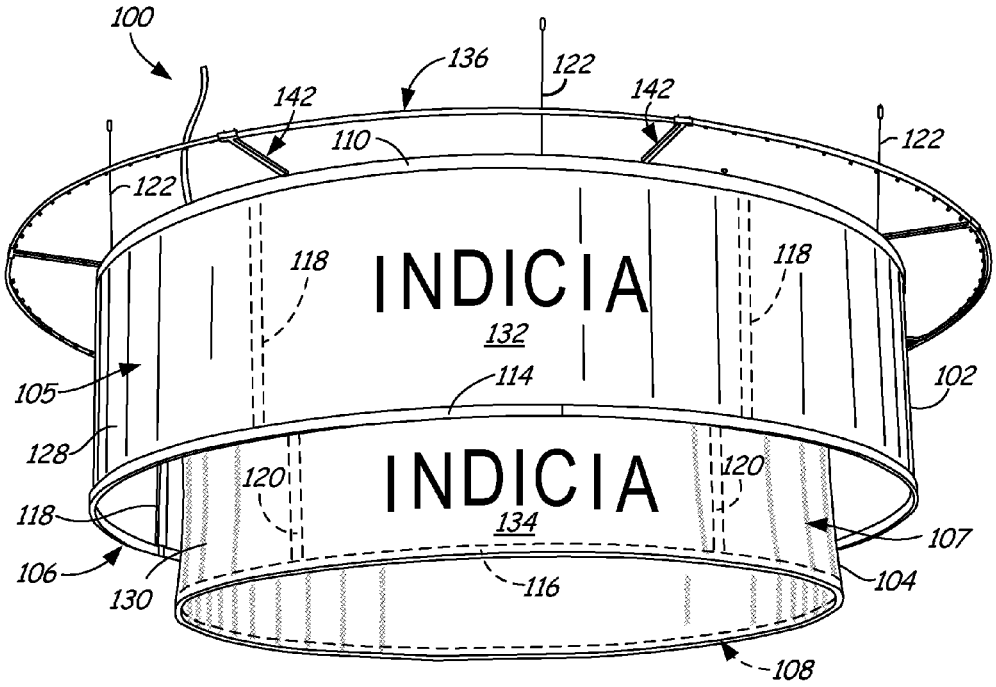
FIG. 1 illustrates a bottom perspective view of a lighted signage structure under one embodiment.
Figure 2:
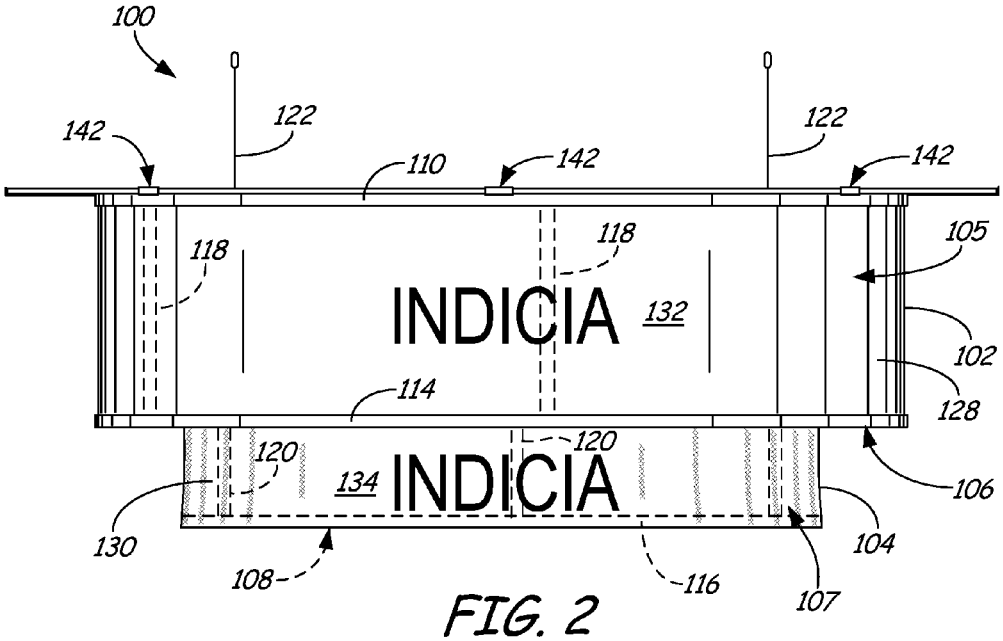
FIG. 2 illustrates a front view of the lighted signage structure of FIG. 1.
Figure 3:
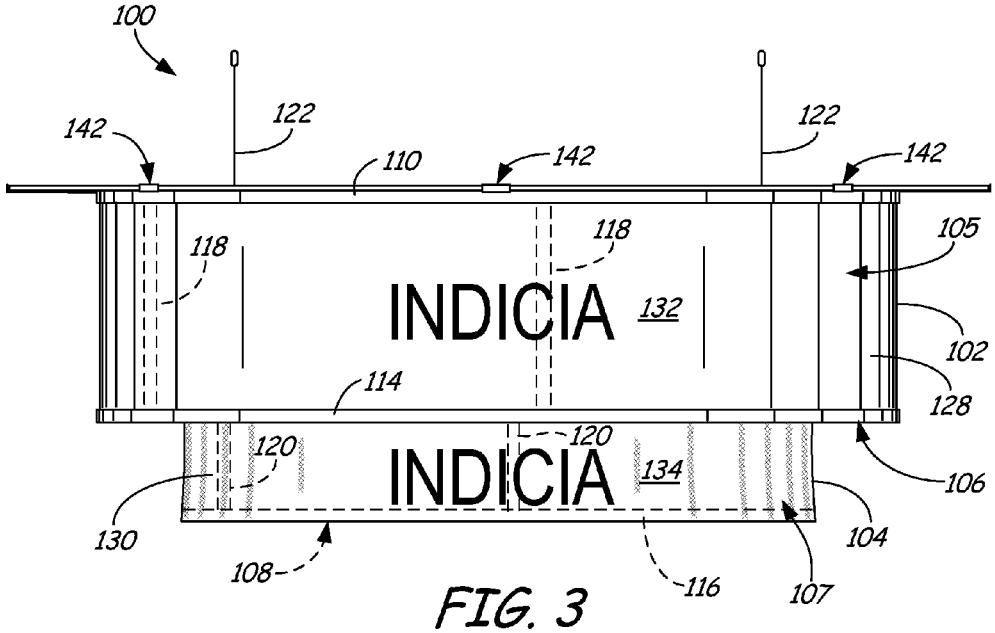
FIG. 3 illustrates a back view of the lighted signage structure of FIG. 1.
Figure 4:
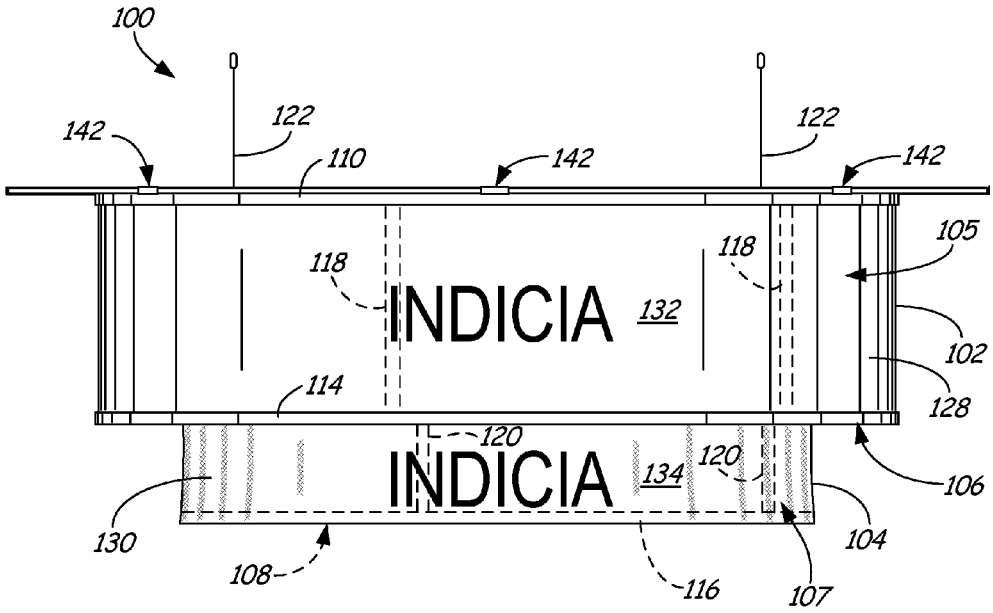
FIG. 4 illustrates a right side view of the lighted signage structure of FIG. 1.
Figure 5:
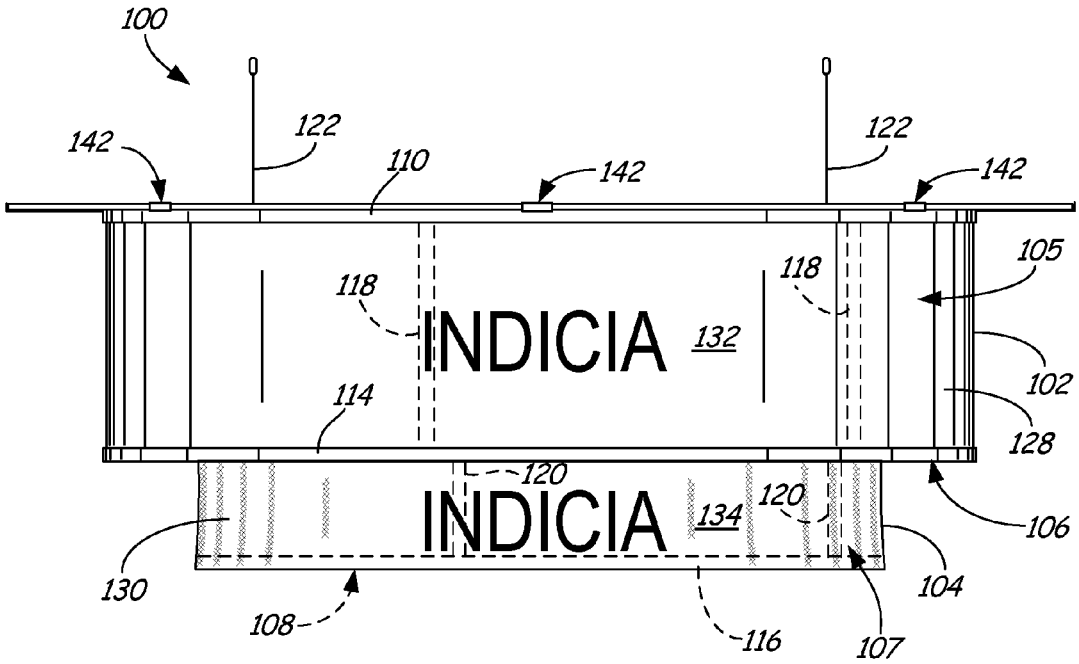
FIG. 5 illustrates a left side view of the lighted signage structure of FIG. 1.

Embodiments are described as a lighted signage structure including nested first and second circular drums having indicia in the form of visual graphics and/or text located on their curved outer surfaces. The lighted signage structure also includes a valance having a plurality of spaced apart lights. The valance is coupled to the first drum with a plurality of bracket assemblies so as to be located outwardly from the outer surface of the first drum and to allow the light to wash over the outer surface of the first drum.

FIGS. 1-8 illustrate bottom perspective, front, back, right side, left side, top, bottom and top perspective views of a lighted signage structure 100 under one embodiment. Lighted signage structure 100 includes a first drum or first barrel 102 and a second drum or second barrel 104. While first and second drums 102 and 104 are illustrated as being circular in shape, in alternative embodiments other shapes are possible. For example, first and second drums 102 and 104 can be square or rectangular.

In the embodiment illustrated in FIGS. 1-8, first drum 102 includes a first circular frame 106 supporting a first material 105 and second drum 104 includes a second circular frame 108 supporting a second material 107. For example, first material 105 can be a plurality of first curved panels made of for example, styrene, while second material 107 can be fabric. Both first and second materials 105 and 107 display indicia in the form of visual graphics and/or text. Both first and second circular frames 106 and 108 include upper frame rings or upper frame channels 110 (FIGS. 1-6 and 8) and 112 (FIG. 8), lower frame rings or lower frame channels 114 (FIGS. 1-5 and 7-8) and 116 (FIGS. 1-5 and 8), vertical frame pieces 118 (FIGS. 1-5 and 8) connecting the upper frame ring or channel 110 to the lower frame ring or channel 114 and vertical frame pieces 120 (FIGS. 1-5 and 8) connecting the upper frame ring or channel 112 to the lower frame ring or channel 116.

Figure 6:
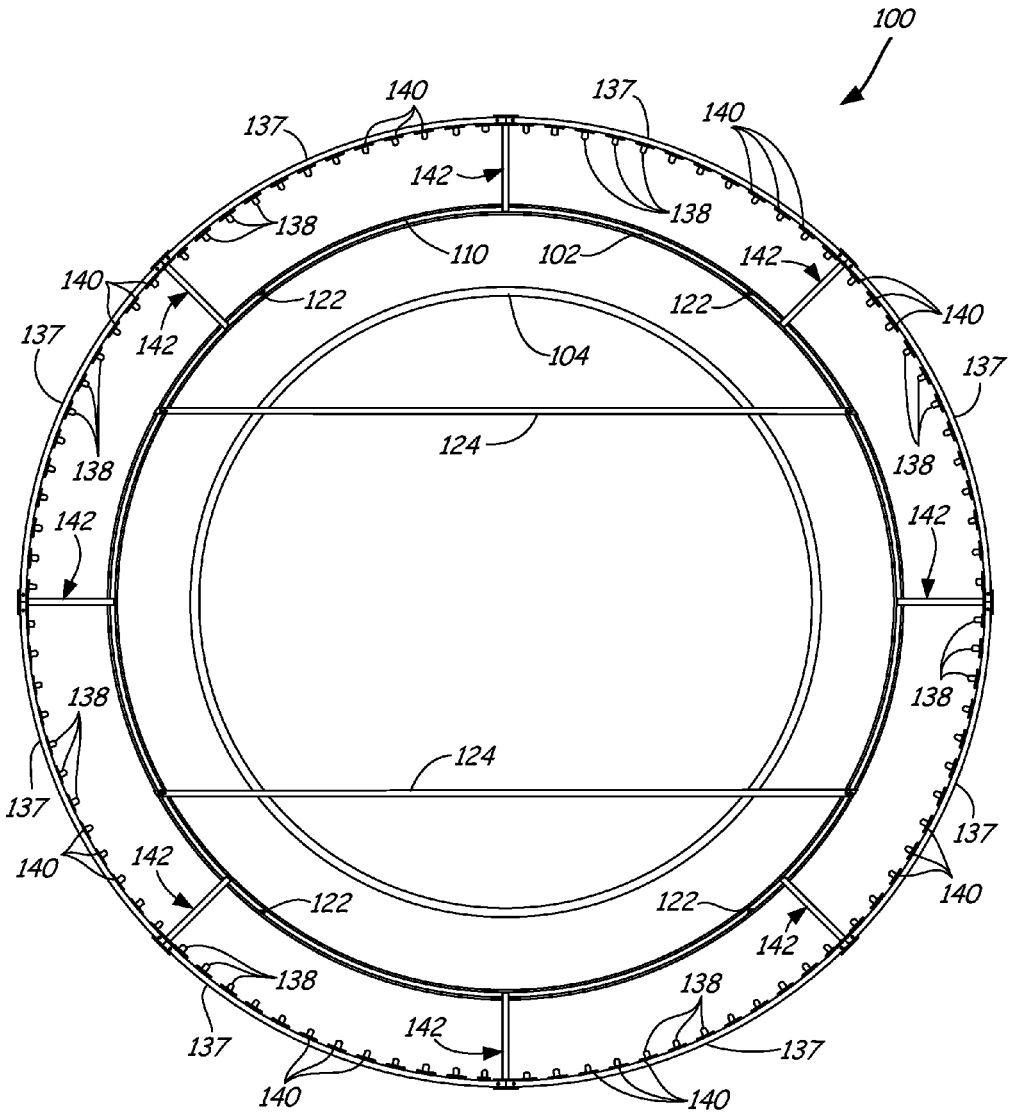
FIG. 6 illustrates a top view of the lighted signage structure of FIG. 1.
Figure 7:
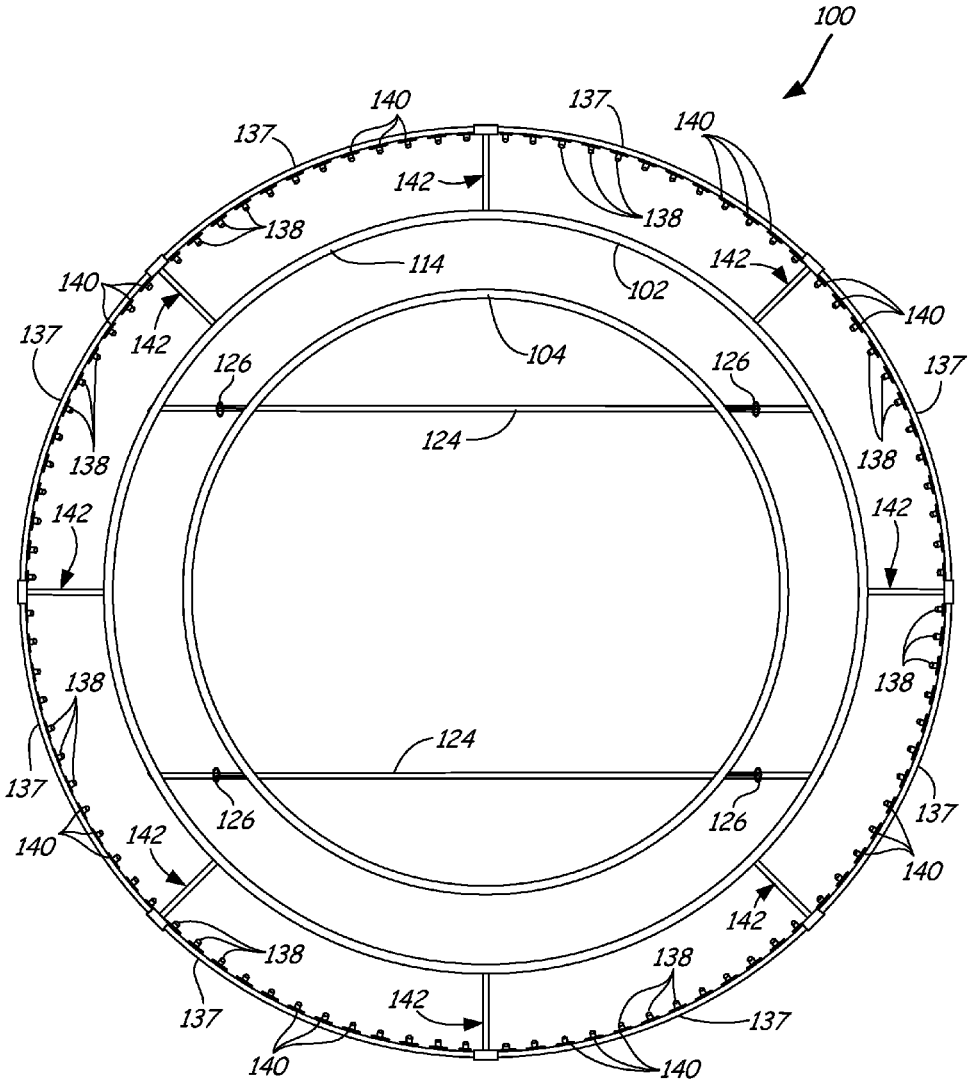
FIG. 7 illustrates a bottom view of the lighted signage structure of FIG. 1.
Figure 8:
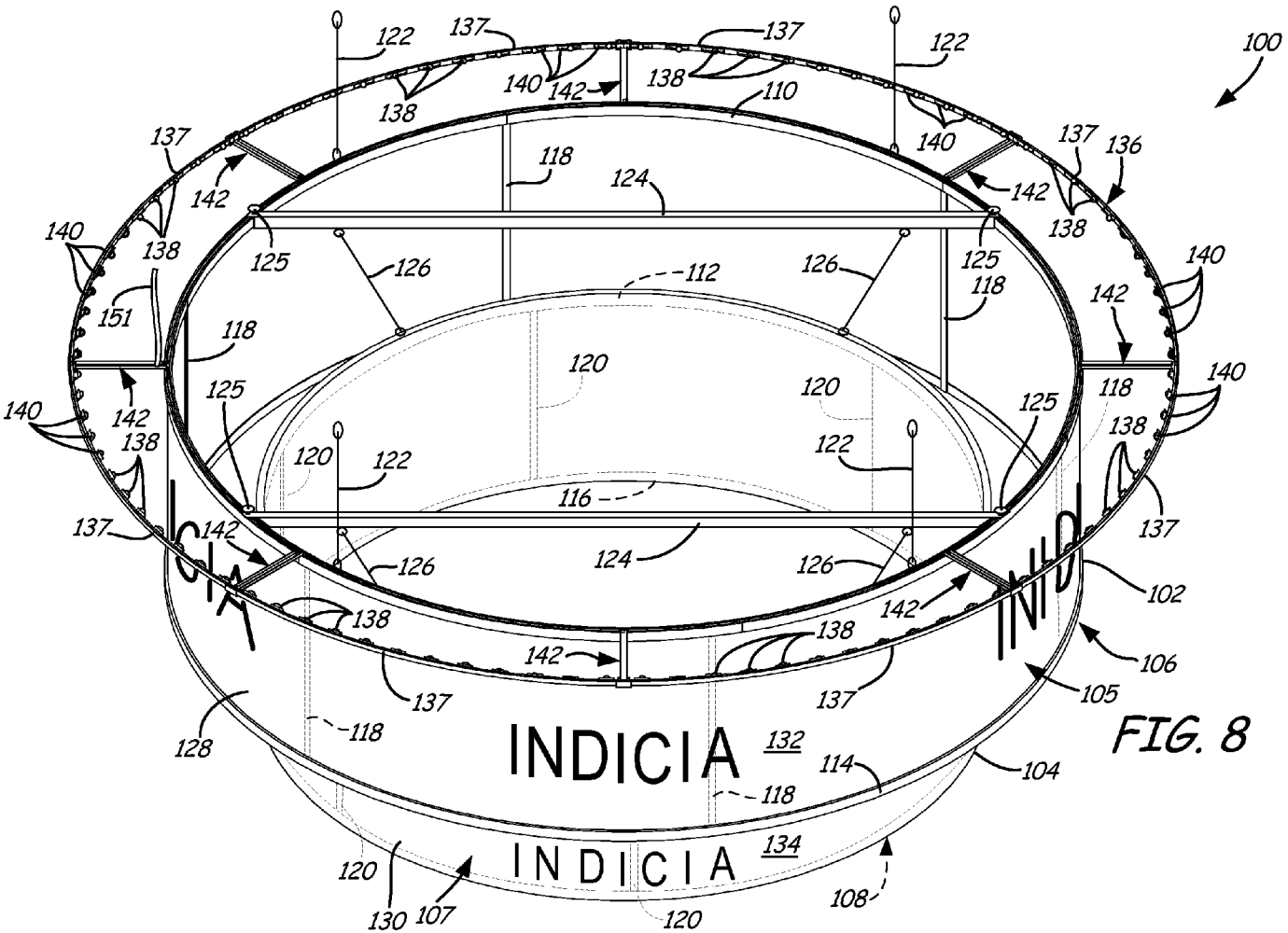
FIG. 8 illustrates a top perspective view of the lighted signage structure of FIG. 1.

As illustrated FIGS. 1-8, first drum or barrel 102 is suspended from a ceiling by four first cable assemblies 122. It should be realized, however, first drum or barrel 102 can be suspended from the ceiling by any number of first cable assemblies 122. Under one embodiment, each of the four cable assemblies 122 directly attach to different points on the ceiling at first ends and directly attach to upper frame ring or channel 110 of first drum 102 at second ends. As illustrated in FIGS. 6-8, first drum 102 also includes a pair of parallel cross bars 124. Parallel cross bars 124 extend along chords rather than through the center of upper ring 110. Second drum or barrel 104 is suspended from the parallel cross bars 124 of first drum 102 by four second cable assemblies 126. It should be realized, however, second drum 104 can be suspended from first drum 102 by any number of second cable assemblies 126. Each of the four second cable assemblies 126 directly attach to the different points on the cross bars 124 at first ends and directly attach to upper frame ring or channel 112 of the second drum 104 at second ends. As illustrated in FIGS. 1-8, upper frame ring 112 of second drum 104 is located below upper frame ring 110 of first drum 102, but not below lower frame ring 114 of first drum 102. Therefore, second drum 104 appears to be nested within first drum 102.

As illustrated in FIGS. 1-8, first circular frame 106 of first drum 102 supports a first material 105 having an outer circumferential surface 128 and second frame 108 of second drum 104 supports a second material 107 having an outer circumferential surface 130. As discussed above and for example, first material 105 can comprise a plurality of panels, such as styrene panels, having outer surfaces and second material 107 can comprise fabric having an outer surface. It should be realized that other materials and configurations are possible. Outer surfaces 128 and 130 include indicia 132 and 134 in the form of visual graphics and/or text. For example, indicia 132 and 134 can be printed or heat embossed onto outer surfaces 128 and 130 of first and second materials 105 and 107. In addition and as illustrated in FIGS. 1-8, indicia 132 and 134 are repeated about the outer surfaces 128 and 130 of first and second materials 105 and 107.

Lighted signage structure 100 also includes a valance or crown 136. Valance 136 is coupled to upper frame ring or channel 110 of first drum 102 by a plurality of bracket or support assemblies 142. Each bracket assembly 142 connects valance 136 to upper frame ring 110 of first drum 102 such that valance 136 is located outwardly from outer surface 128 of first drum 102. It should be realized that valance or crown 136 is not attached directly to the ceiling or directly supported by the ceiling. Rather, as stated, valance 136 is coupled to and supported by first drum 102 via the plurality of bracket assemblies 142.

Valance 136, in the embodiment illustrated in FIGS. 1-8, includes a plurality of curved metal sections 137 and a plurality of spaced apart lights 138. When curved metal sections 137 are positioned adjacent to each other, they form a circular hoop. For example, valance or crown 136 can be made of aluminum and include eight curved sections 137 having curved arcs of 45 degrees fitted adjacent to each other to form the continuous hoop. It should be realized that valance 136 can be made of any number of curved sections including a single curved section and may be made of different types of metallic material. In addition, sections 137 can be straight sections if the drums 102 and 104 are of other types of shapes, for example square or rectangular.

Figure 9:
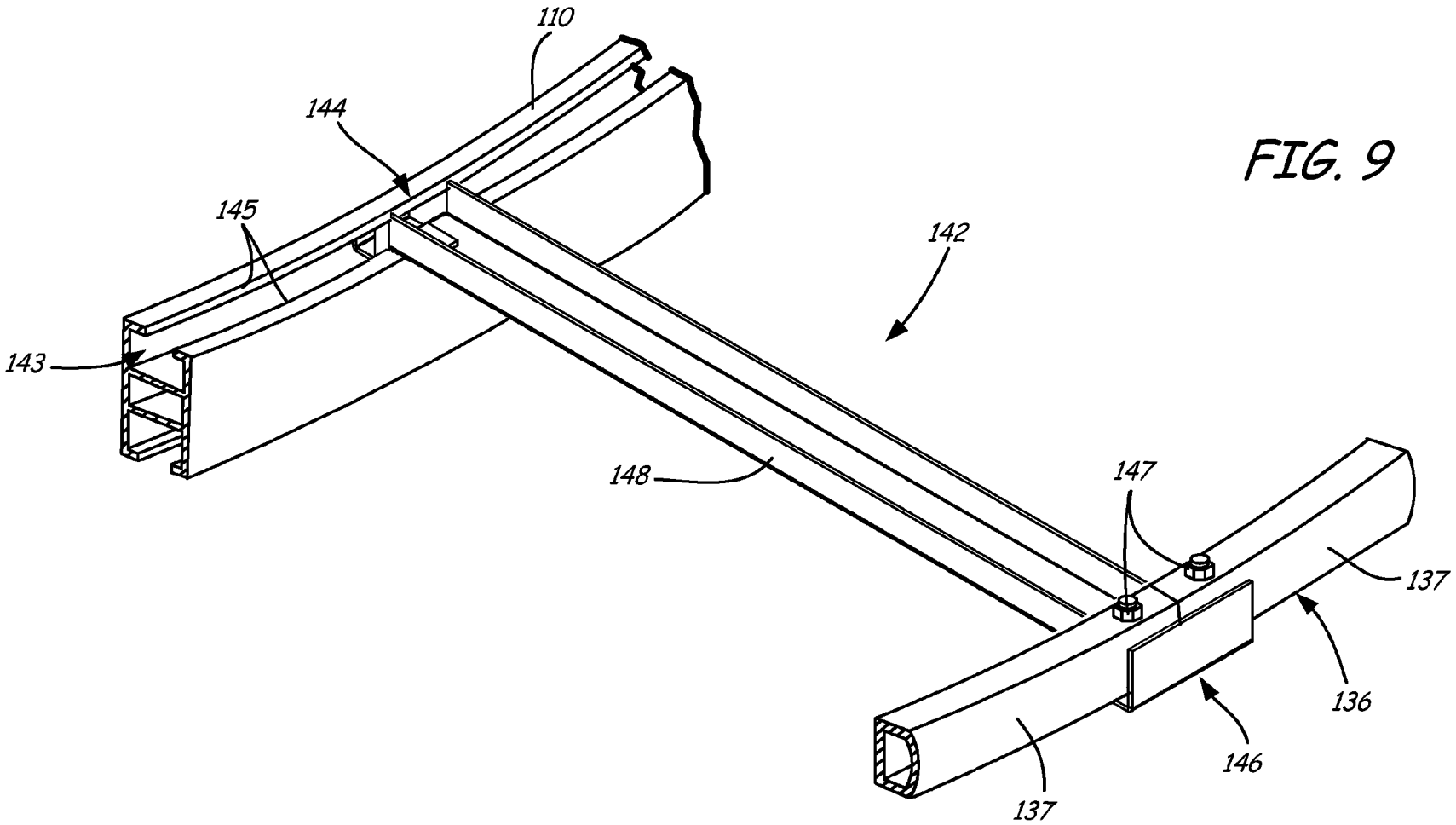
FIG. 9 is an enlarged detailed view of one of the bracket assemblies shown in FIGS. 1-8 and illustrated from an exterior side of a valance under one embodiment.

FIG. 9 is an enlarged detailed view of bracket or support assembly 142 including valance 136 and upper frame ring 110 as illustrated from an exterior side of valance 136 under one embodiment. Bracket assembly 142 includes a main body 148 having a first end 144 configured for attaching to upper frame ring or channel 110 and a second end 146 configured for attaching to valance or crown 136. As illustrated in FIG. 9, upper frame ring 110 includes an upper channel 143, a central channel and a lower channel. Upper channel 143 includes a groove 145 that provides upper channel 143 with a top opening to receive first end 144 of main body 148. The central channel is closed and, like upper channel 143, the lower channel also includes a groove that provides the lower channel with a bottom opening to receive first material 105 of first drum 102.

Second end 146 of main body 148 attaches to valance 136 at a location where two curved metal sections 137 are located adjacent to each other. At this location, each end of the adjacent curved metal sections include an aperture for receiving components of bracket assembly 142 such that valance 136 can be secured to main body 148 of bracket assembly 142 with a pair of fasteners 147, such as hex nuts. It should be realized that bracket or support assemblies 142 can have a variety of different configurations than those exemplarily shown in FIG. 9.

Figure 10:
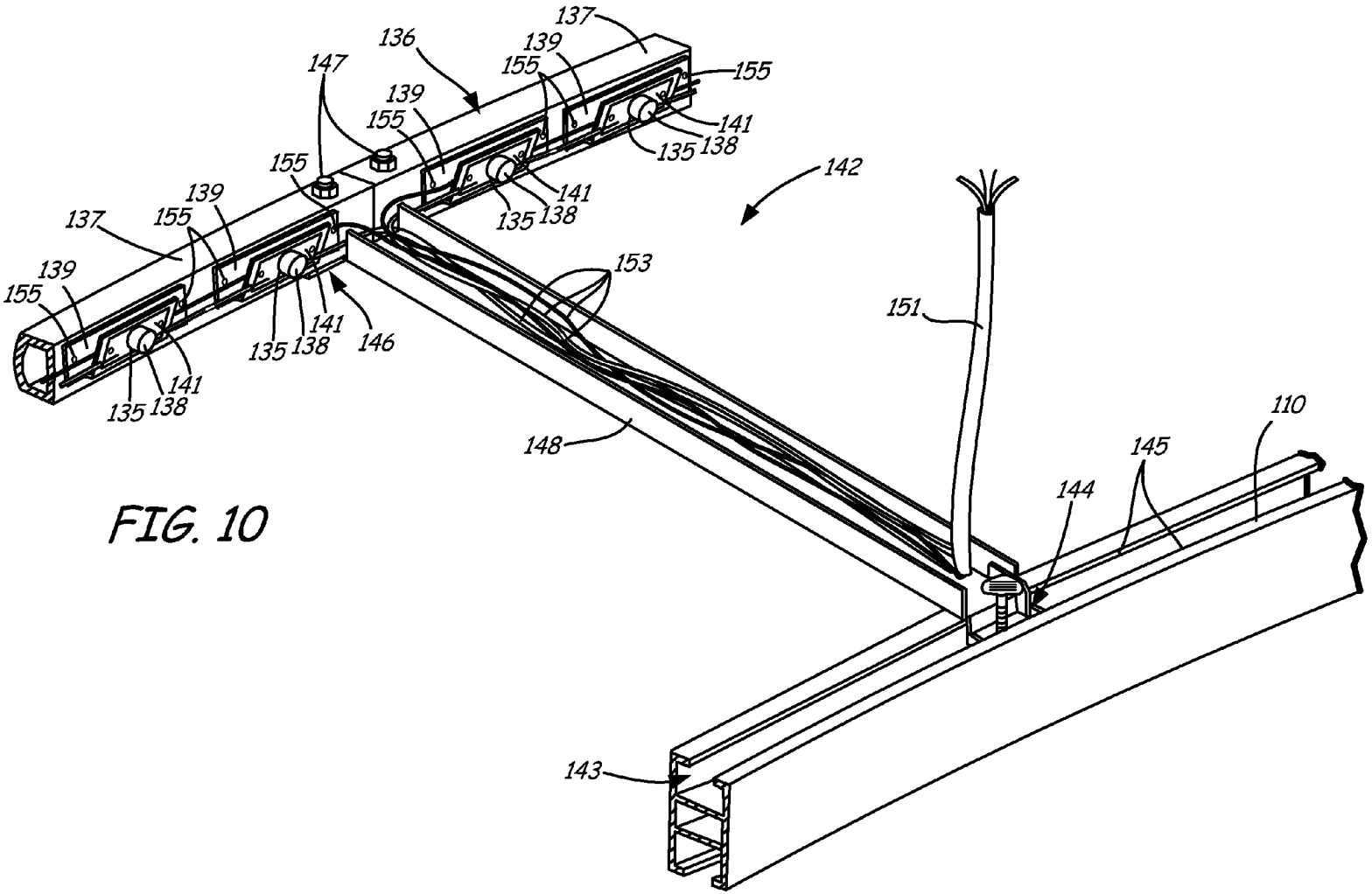
FIG. 10 is an enlarged detailed view of the bracket assembly shown in FIG. 9 and illustrated from an interior side of the valance.

FIG. 10 is an enlarged detailed view of bracket assembly 142 including valance 136 and upper frame ring 110 as illustrated in FIG. 9, but is illustrated from an interior side of valance 136. With reference also to FIG. 8, each of the plurality of lights 138 are mounted to spaced apart mounting plates 140, which are fastened by, for example rivets 155, to an interior side of curved metal sections 137 of valance or crown 136 at first legs 139. Second legs 141 of mounting plates 140 extend at an angle to the vertical interior sides of metal sections 137 such that second legs 141 protrude or extend inwardly from the interior side of each curved metal section 137 towards the outer surface 128 of first drum 102. For example, second legs 141 of mounting plates 140 extend from the interior side of a curved metal section 137 such that second legs 141 are at 45 degree angle to the interior side of curved metal section 137. The angle at which second legs 141 extend allow the outer surface 128 of first drum 102 to be substantially completely illuminated. In addition, each light 138 is covered by a light dispersing element 135, such as for example a lens 135. Light scattering elements or light scattering lenses 135 are of the type that are configured to diverge or disperse the light so that it better washes outer surface 128 of first drum 102.

As illustrated in FIGS. 8 and 10, a power cord 151 extending from one of the bracket assemblies 142 into the ceiling is connected to a power source. The power cord 151 is located above the top side of the bracket assembly 142 and provides electrical wires 153 that run to and from the lights 138. As illustrated more clearly in FIG. 10, electrical wires 153 supply power and electrically couple the lights around the interior side of valance 136.

With reference back to FIG. 6, each curved section 137 includes twelve mounting plates 140 supporting twelve LED (light emitting diode) type lights 138 and corresponding lenses 135 that emit white light. In particular, each light 138 is spaced a distance of approximately 5 inches. However, other distances are possible and largely depend on the size of each curved section 137. In addition, it should be realized that curved sections 137 can include any number of mounting plates 140 and mounting plates 140 can include any of a variety of different number, type and color of lights 138 and different types of lenses. For example, rather than LED-type lights, lights 138 can be incandescent, fluorescent or the like.

Figure 11:
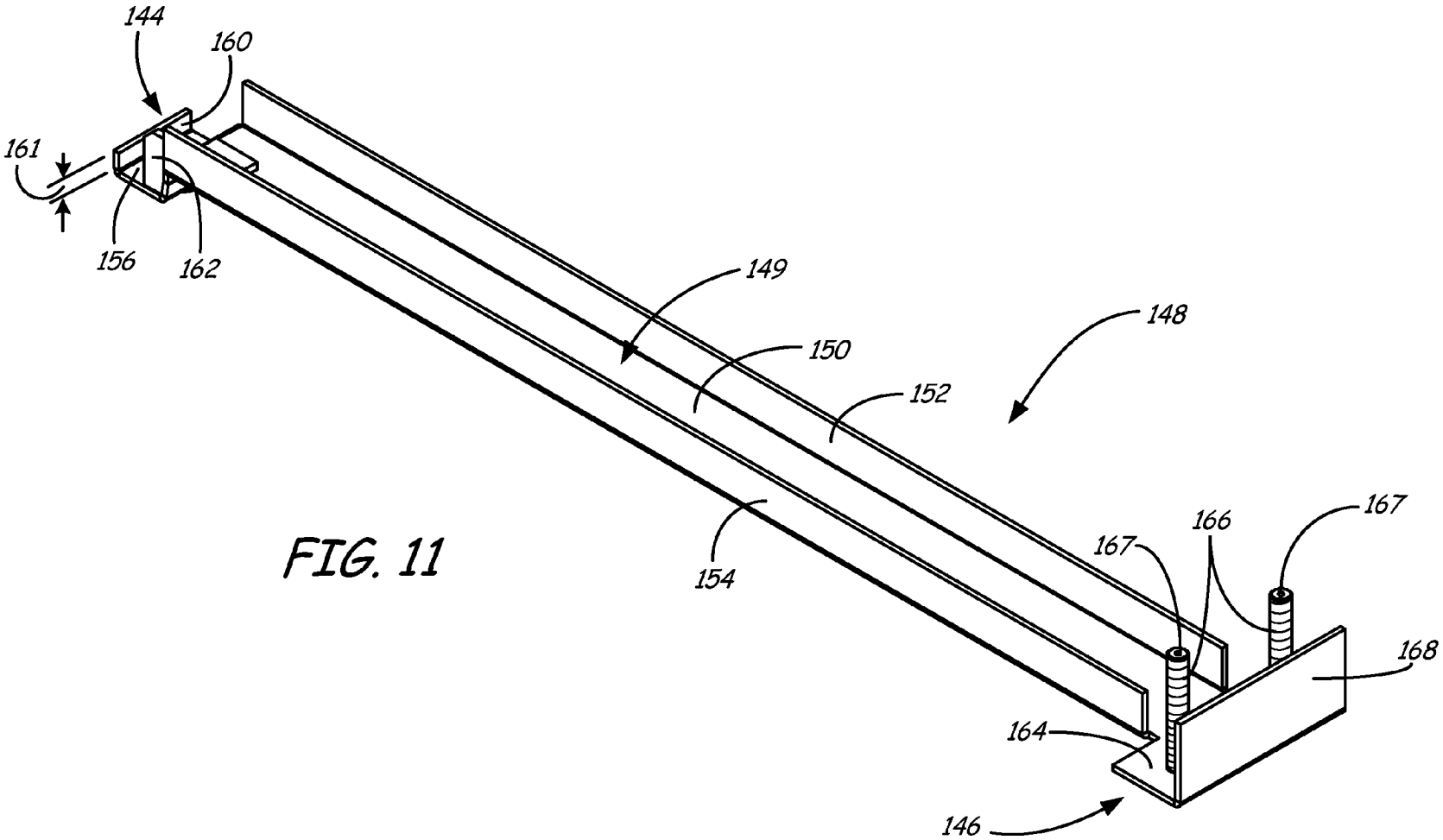
FIG. 11 is a top perspective view of an arm of the bracket assembly illustrated in FIGS. 9 and 10.
Figure 12:
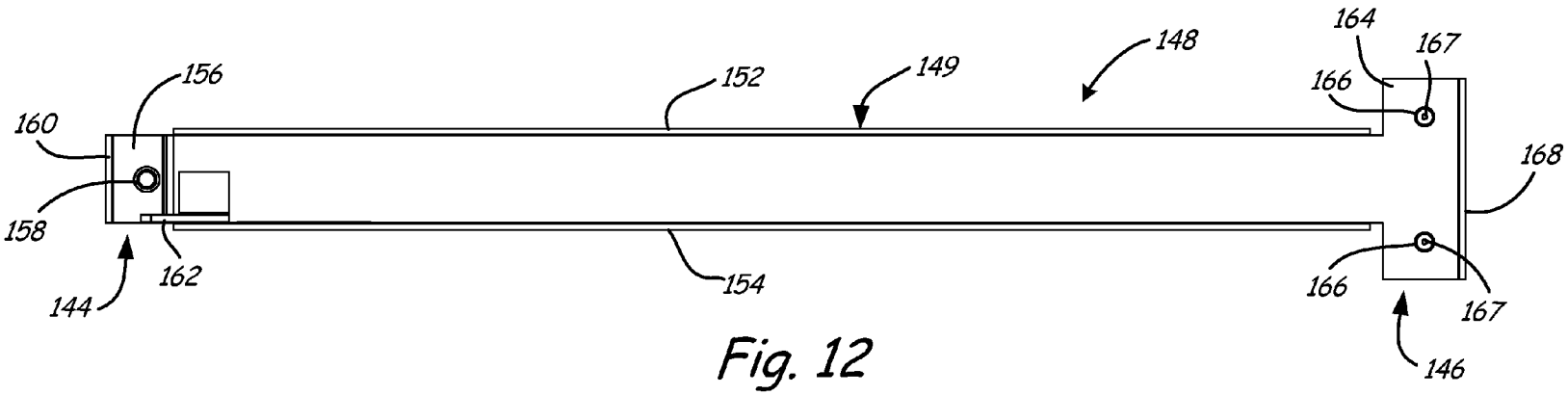
FIG. 12 is a top view of the arm of the bracket assembly illustrated in FIGS. 9-11.
Figure 13:
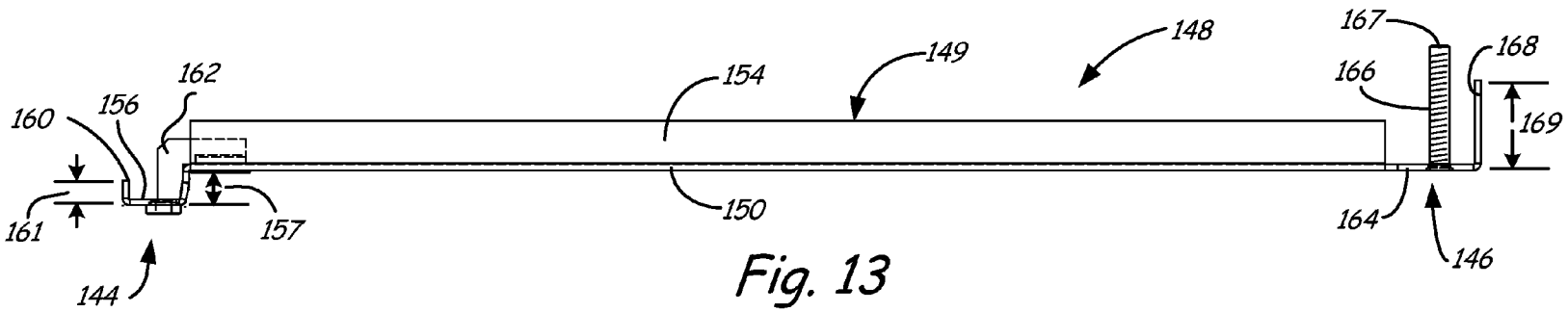
FIG. 13 is a side view of the arm of the bracket assembly illustrated in FIGS. 9-12.

FIGS. 11-13 illustrate enlarged perspective, top and side views of the bracket or support assembly 142 illustrated in FIGS. 9 and 10. As previously described, bracket assembly 142 includes main body 148 having first end 144, second end 146 and an arm 149 extending between the first end 144 and the second end 146. First end 144 is configured for attaching to upper channel 142 of upper frame ring 110 through groove 145 while second end 146 is configured for attaching to valance or crown 136. As illustrated, arm 149 comprises a sheet metal that is bent along its longitudinal sides such that it has a substantially planar section 150, a first side wing 152 and a second side wing 154. The bent sides provide main body 148 with structural integrity. However, it should be realized that arm 149 can have other configurations. For example, the entire arm 149 can be substantially planar.

First end 144 includes a recessed section 156 integrally formed with arm 149 and is substantially parallel with and recessed from substantially planar section 150 of arm 149 by a first height 157. Recessed section 156 includes an aperture 158 for receiving a fastener. First end 144 also includes a first lip 160 integrally formed with recessed section 156 at its lateral edge so as to provide a substantially planar surface having a second height 161 that is less than first height 157. The plane that first lip 160 occupies is oriented substantially perpendicular to the plane recessed section 156 occupies and the plane substantially planar section 150 and first and second side wings 152 and 154 occupy. A gusset or plate 162 is welded to arm 149 at substantially planar section 150 and to recessed section 156 for strengthening first end 144.

Second end 146 includes a base section 164 integrally formed with arm 149 and substantially parallel with and in plane with substantially planar section 150. Attached to base section 164 are a pair of threaded studs 166. The pair of threaded studs 166 protrude upward from base section 164 and extend to a distal end 167. The pair of threaded studs 166 are configured to be inserted through the apertures in curved metal sections 137 to secure second end 146 to valance or crown 136. Second end 146 also includes a second lip 168 located on the lateral edge of base section 164. Second lip 168 is integrally formed with base section 164 so as to provide a substantially planar surface having a third height 169. The plane that second lip 168 occupies is oriented substantially perpendicular to the plane base section 164 and substantially planar section 150 and first and second side wings 152 and 154 occupy.

Figure 14:
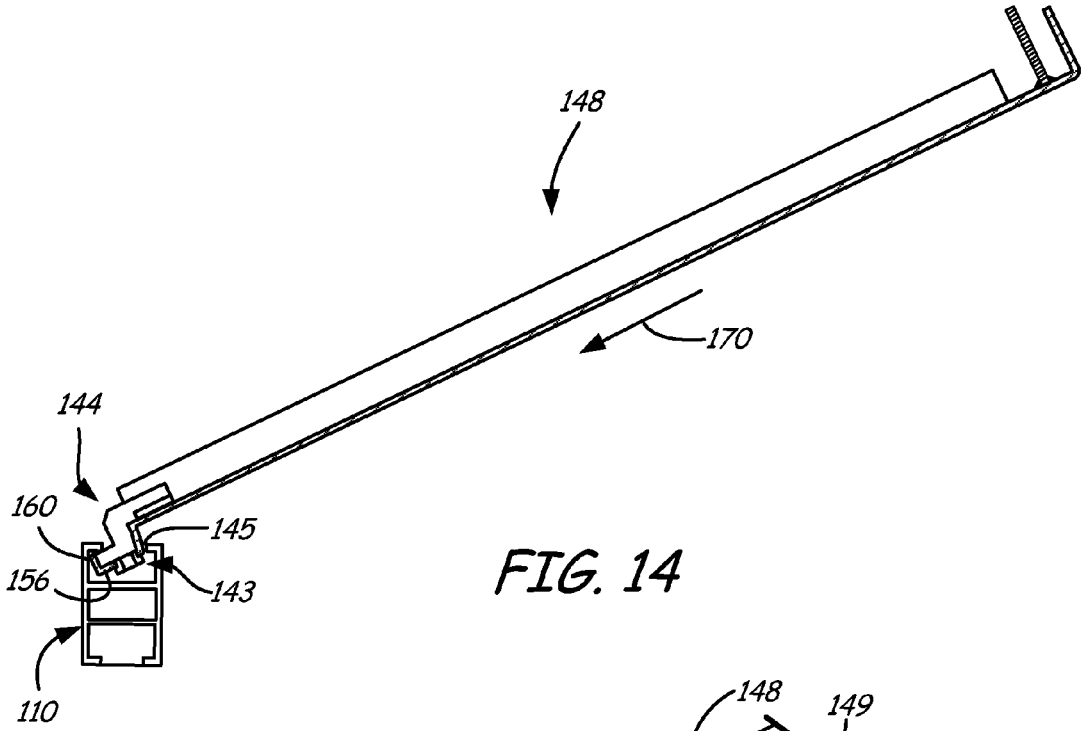
FIG. 14 illustrates a sectional view of the arm of the bracket assembly being inserted into an upper frame ring of a first drum of the lighted signage structure.

FIG. 13 illustrates a sectional view of first end 144 of bracket assembly 142 being assembled to upper frame ring 110 of first drum 102. As illustrated, recessed section 156 and first lip 160 are inserted through groove 145 by moving main body 148 in a direction 170. FIG. 14 illustrates an enlarged sectional view of second end 144 of bracket assembly 142. After recessed section 156 and first lip 160 are inserted through groove 145, recessed section 156 and first lip 160 are positioned within upper channel 143 by moving arm 149 in a direction 171 such that first lip 160 holds recessed section 156 within upper channel 143.

Figure 15:
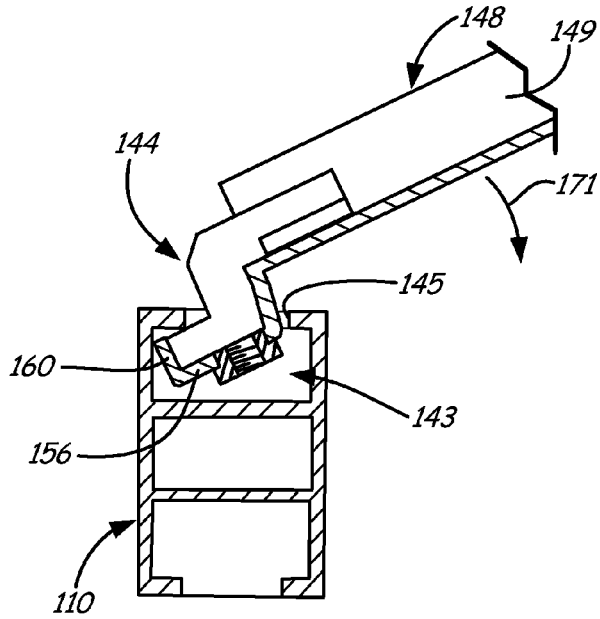
FIG. 15 illustrates an enlarged sectional view of a first end of the arm being inserted into the upper frame ring of the first drum of the light signage structure shown in FIG. 14.
Figure 16:
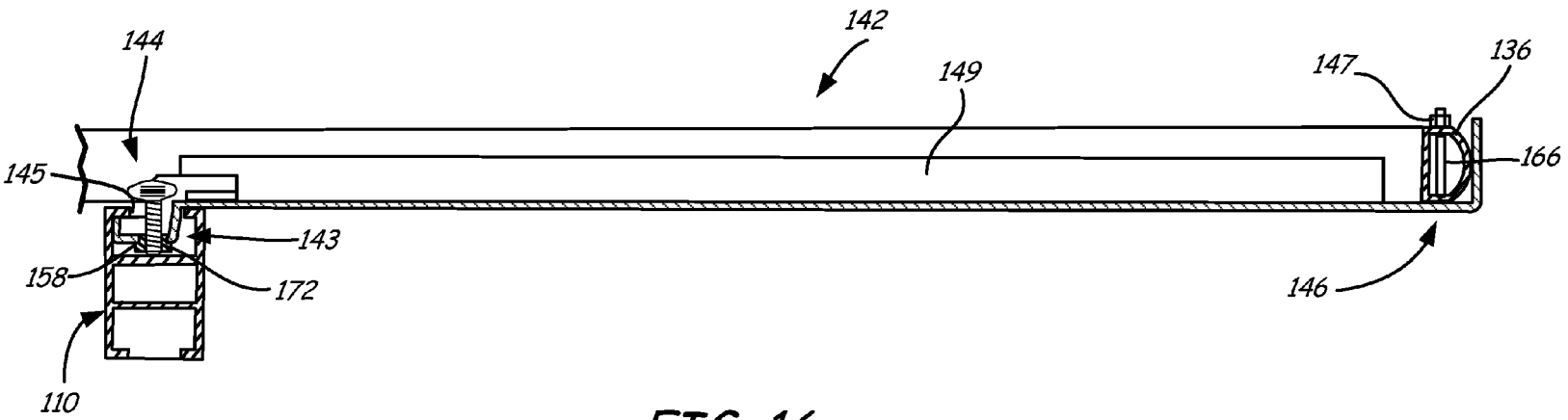
FIG. 16 is sectional view of the bracket assembly attaching a lighted valance to the first drum.

FIG. 15 illustrates a sectional view of an assembled bracket or support assembly 142. In FIG. 15, bracket assembly 142 is attached to upper frame ring 110 of first drum 102 at first end 144 of arm 149 and attached to valance or crown 136 at second end 146 of arm 149. As illustrated, a fastener 172, such as a thumb screw, is threaded through aperture 158 in recessed section 156 so that it contacts the bottom of upper channel 143 to secure first end 144 into upper channel 143 of upper frame ring 110. Also in FIG. 15, second end 146 of bracket assembly 142 is attached to valance or crown 136 by inserting studs 166 through the apertures in the curved metal sections 137 of valance 136 and then providing fasteners 147 to secure the threaded studs 166 to valance 136. As described earlier, after studs 166 are inserted through the apertures, fasteners 147, such as hex nuts, are received by studs 166.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A signage structure comprising:

a first drum suspended from a ceiling and including a first frame supporting a first material having an outer circumferential surface for displaying indicia, the first frame including an upper frame ring and a lower frame ring;

a valance located outwardly from the outer circumferential surface of the first drum and including at least one curved section having a plurality of spaced apart lights positioned along the interior side of the valance to direct light onto the outer circumferential surface of the first drum; and a plurality of bracket assemblies having arms that couple the upper frame ring of the first drum to the valance, wherein a first end of each arm is configured to attach to the upper frame ring of the first drum and a second end of each arm is configured to attach to the valance.

2. The signage structure of claim 1, further comprising a second drum suspended from the first drum and including a second frame supporting a second material having an outer circumferential surface for displaying indicia, the second frame including an upper frame ring positioned below the upper frame ring of the first drum, but above the lower frame ring of the first drum.

3. The signage structure of claim 1, wherein the at least one curved section of the valance comprises a plurality of curved sections that are positioned adjacent to each other to form a continuous hoop.

4. The signage structure of claim 1, wherein the valance further comprises a plurality of mounting plates for supporting each of the plurality of spaced apart lights, wherein a first end of each mounting plate is coupled to the valance and a second end of each mounting plate extends from the interior side of the valance inwardly toward the outer circumferential surface of the first drum so that the mounting plate is at an angle to the interior side of the valance.

5. The signage structure of claim 1, wherein each light is covered by a light scattering element to illuminate the indicia on the outer circumferential surface of the first drum.

6. The signage structure of claim 1, wherein the upper frame ring of the first drum comprises an upper channel having a groove that provides the upper channel with an opening.

7. The signage structure of claim 6, wherein each arm of each bracket assembly comprises a substantially planar section extending between the first end and the second end.

8. The signage structure of claim 7, wherein the first end of each arm of each bracket assembly comprises:

a recessed section integrally formed with the substantially planar section and recessed from the substantially planar section by a first height, the recessed section including an aperture; and a first lip formed integrally with the recessed section and spaced apart from the substantially planar section, the first lip extending upwards by a second height along a plane from the recessed section, the second height being less than the first height and the first lip being substantially perpendicular to a plane of the recessed section and a plane of the substantially planar section.

9. The signage structure of claim 8, wherein the recessed section and the first lip are inserted through the groove and into the upper channel of the upper frame ring and secured to the upper frame ring with a fastener.

10. The signage structure of claim 7, wherein the second end of each arm of each bracket assembly comprises:

a base section integrally formed with and in plane with the substantially planar section;

a pair of studs attached to and extending from the base section to a distal end; and a second lip formed integrally with the base section and extending upwards by a third height along a plane from the base section, the second lip being substantially perpendicular to a plane of the base section and a plane of the substantially planar section.

11. The signage structure of claim 10, wherein one of the pair of studs is inserted into an aperture in a first curved section of the valance and the other of the pair of studs is inserted into an aperture in a second curved section of the valance, and wherein the pair of studs are secured to the valance with a pair of fasteners.

12. A method of applying lighting to a signage structure, the method comprising:

obtaining a first drum including a first frame supporting a first material having an outer circumferential surface for displaying indicia, the first frame including an upper frame ring and a lower frame ring;

attaching first ends of a plurality of bracket assemblies to the upper frame ring of the first drum; and attaching a valance to second ends of the plurality of bracket assemblies to locate the valance outwardly from the outer circumferential surface of the first drum, the valance including at least one curved section having a plurality of spaced apart lights positioned along the interior side of the valance to direct light onto the outer circumferential surface of the first drum.

13. The method of claim 12, wherein attaching first ends of the plurality of bracket assemblies to the upper frame ring of the first drum comprises:

providing the upper frame ring of the first drum with an open upper channel having a groove;

providing each first end of each bracket assembly with an aperture;

inserting the first ends of each bracket assembly through the groove and into the upper channel of the upper frame ring; and securing each first end of each bracket assembly to the upper frame ring by positioning a fastener through each aperture.

14. The method of claim 12, wherein attaching a valance to second ends of the plurality of bracket assemblies comprises:

providing each second end of each bracket assembly with a pair of studs;

inserting the pair of studs into apertures in the valance; and securing each second end to the valance by providing fasteners that are received by the pair of studs.

15. A signage structure comprising:

a first barrel suspended from a ceiling and including a first circular frame supporting a plurality of first curved panels having outer surfaces for displaying indicia, the first circular frame including an upper frame channel and a lower frame channel;

a second barrel suspended from the first barrel and including a second circular frame having an upper frame channel and a lower frame channel that supports fabric for displaying indicia, the upper frame channel of the second barrel being positioned between the upper frame channel and the lower frame channel of the first barrel and the lower frame channel of the second barrel being positioned below the lower frame channel of the first barrel;

a crown located outwardly from the first barrel and including a plurality of adjacent curved sections which together form a continuous hoop, the crown having a plurality of spaced apart lights positioned along the interior side of the crown to direct light onto the outer surface of the plurality of curved panels of the first barrel; and a plurality of support assemblies that couple the upper frame channel of the first barrel to the crown, wherein a first end of each support assembly is configured to attach to the upper frame channel of the first drum and a second end of each support assembly is configured to attach to the crown.

16. The signage structure of claim 15, wherein the crown further comprises a plurality of mounting plates for supporting each of the plurality of spaced apart lights, wherein a first end of each mounting plate is coupled to the crown and a second end of each mounting plate extends from the interior side of the crown inwardly toward the outer surface of the plurality of first curved panels of the first barrel so that the mounting plate is at an angle to the interior side of the crown.

17. The signage structure of claim 15, wherein each light is covered by a light scattering element to illuminate the indicia on the outer surface of the plurality of first curved panels of the first barrel.

18. The signage structure of claim 15, wherein the upper frame channel of the first barrel comprises an upper channel having a groove that provides the upper channel with an opening.

19. The signage structure of claim 15, wherein the first end of each support assembly comprises:

a recessed section integrally formed with a substantially planar section and recessed from the substantially planar section by a first height, the recessed section including an aperture; and a first lip formed integrally with the recessed section and spaced apart from the substantially planar section, the first lip extending upwards by a second height along a plane from the recessed section, the second height being less than the first height and the first lip being substantially perpendicular to a plane of the recessed section and a plane of the substantially planar section.

20. The signage structure of claim 19, wherein the second end of each support assembly comprises:

a base section integrally formed with and in plane with the substantially planar section;

a pair of studs attached to and extending from the base section to a distal end; and a second lip formed integrally with the base section and extending upwards by a third height along a plane from the base section, the second lip being substantially perpendicular to a plane of the base section and a plane of the substantially planar section.

* * * * *